US010222185B2

(12) United States Patent
Meyer

(10) Patent No.: US 10,222,185 B2
(45) **Date of Patent: *Mar. 5, 2019**

(54) SHOTSHELL WITH REDUCED DISPERSION OF PROJECTILES

(71) Applicant: Olin Corporation, St. Louis, MO (US)

(72) Inventor: Stephen W. Meyer, Glen Carbon, IL (US)

(73) Assignee: OLIN CORPORATION, St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/012,743

(22) Filed: Feb. 1, 2016

(65) Prior Publication Data

US 2016/0298946 A1 Oct. 13, 2016

Related U.S. Application Data

(63) Continuation of application No. 13/854,931, filed on Apr. 1, 2013, now Pat. No. 9,250,048.

(51) Int. Cl.
*F42B 7/04* (2006.01)
*F42B 7/08* (2006.01)

(52) U.S. Cl.
CPC ..... *F42B 7/043* (2013.01); *F42B 7/04* (2013.01); *F42B 7/08* (2013.01)

(58) Field of Classification Search
CPC .. F42B 7/04; F42B 7/043; F42B 7/046; F42B 7/08; F42B 7/10
USPC ..... 102/448, 449, 451, 452, 450, 455, 454, 102/457, 459
See application file for complete search history.

(56) References Cited

U.S. PATENT DOCUMENTS

| | | | | |
|---|---|---|---|---|
| 12,545 A * | 3/1855 | Davis | F42B 7/04 102/452 |
| 34,806 A | 3/1862 | Budd | |
| 2,820,412 A | 1/1958 | Beeuwkes, Jr. et al. | |
| 3,059,578 A | 10/1962 | Hegge et al. | |
| 3,092,026 A | 6/1963 | Williams et al. | |
| 3,279,375 A | 10/1966 | Herter | |

(Continued)

FOREIGN PATENT DOCUMENTS

| | | | |
|---|---|---|---|
| GB | 985364 A * | 3/1965 | F42B 7/04 |
| WO | WO 0002004 A9 * | 7/2000 | F42B 7/04 |

OTHER PUBLICATIONS

Smash! Plastic Breakaway Glass Plastic. Datasheet [online] Smooth-On Jul. 12, 2012 [retrieved on Aug. 9, 2014] Retrieved from the Internet: <URL:https://web.archive.org/web/20120712095321/http://www.smooth-on.com/tb/files/Smash!.sub.—Plastic.pdf>.

(Continued)

*Primary Examiner* — James S Bergin
(74) *Attorney, Agent, or Firm* — Harness, Dickey & Pierce, P.L.C.

(57) ABSTRACT

An improved shotshell of the type having a hull, a head at the proximal end, propellant disposed in the hull, a wad disposed in the hull distal to the propellant, and a load disposed in the hull in distal to the wad. The improvement comprises the load including a plurality of individual shot, at least a portion of which are at least partially surrounded by a friable material that breaks up upon the firing of the shell to release to the shot and results in a reduced rate of dispersion of the plurality of individual shot compared to cartridges without the friable material.

22 Claims, 2 Drawing Sheets

(56) References Cited

U.S. PATENT DOCUMENTS

| | | | | |
|---|---|---|---|---|
| 3,332,352 | A | 7/1967 | Olson et al. | |
| 3,363,561 | A * | 1/1968 | Irons | F42B 7/046 102/459 |
| 3,368,489 | A | 2/1968 | Herter | |
| 3,422,761 | A | 1/1969 | Whitmore | |
| 3,599,568 | A | 8/1971 | Shellnutt et al. | |
| 3,656,433 | A | 4/1972 | Thrailkill et al. | |
| 4,080,899 | A | 3/1978 | Luban | |
| 4,307,664 | A | 12/1981 | Vollers | |
| 4,733,611 | A | 3/1988 | Janay et al. | |
| 4,913,054 | A | 4/1990 | Petersen | |
| 4,996,923 | A | 3/1991 | Theising | |
| 5,138,950 | A | 8/1992 | Gardner et al. | |
| 5,264,022 | A | 11/1993 | Haygarth et al. | |
| 6,202,561 | B1 * | 3/2001 | Head | F42B 7/04 102/430 |
| 6,367,388 | B1 | 4/2002 | Billings | |
| 8,276,519 | B2 | 10/2012 | Menefee, III et al. | |
| 9,046,328 | B2 | 6/2015 | Nauman et al. | |
| 9,250,048 | B2 | 2/2016 | Meyer | |

OTHER PUBLICATIONS

International Search Report and Written Opinion for PCT/US2014/030528 dated Sep. 5, 2014 pp. 11.
International Preliminary Report on Patentability for PCT/US2014/030528 dated Sep. 15, 2015 pp. 7.
European Search Report for the corresponding EP Patent Application No. 14765460.2 dated Oct. 6, 2016 pp. 10.

* cited by examiner

SHOTSHELL WITH REDUCED DISPERSION OF PROJECTILES

CROSS-REFERENCE TO RELATED APPLICATIONS

This application claims priority to U.S. application Ser. No. filed Ser. No. 13/854,931 on Apr. 1, 2013. The disclosure of the above-referenced application is incorporated herein by reference in its entirety.

FIELD

This disclosure relates to ammunition, and in particular, to shotshell cartridges.

BACKGROUND

This section provides background information related to the present disclosure which is not necessarily prior art.

Shotshells can propel a single projectile, such as a slug, or more commonly, multiple projectiles, such as birdshot or buckshot. The dispersion of multiple shot pellets at a given distance from the muzzle affords a greater chance of hitting a moving target than the singular path of a slug. Thus, a moderate dispersion rate is desirable for some applications, such as waterfowl, upland, and rabbit hunting where the intended target is moving. However, in some applications, such as turkey hunting, the intended target is relatively motionless and small. In these types of applications, it can be desirable to have a tighter pattern, with less shot dispersion.

The rate of dispersion of multiple projectile loads can be influenced by gun systems and cartridge design. Tighter constrictions or "choke" in the muzzle section of the barrel can reduce the dispersion rate of shot pellets to some degree. Cartridge design elements, such as shot type, wad type, and buffering can also reduce dispersion rate.

Lead was the material of choice for early cartridges because of its density, relatively low cost, and easy formability. The easy formability however was also a negative. Soft lead pellets are deformed when subjected to the high acceleration forces of cartridge ignition and with direct barrel contact while being accelerated toward the muzzle. Early cartridges did not incorporate any shot wad systems. Soft lead shot had direct contact with the barrel. This resulted in a considerable dispersion rate. Eventually wads and shot cups provided a liner or barrier between the shot and barrel to reduce pellet deformation associated with bore contact. U.S. Pat. No. 3,092,026, incorporated granulated particles intermixed in the shot column to "buffer" the pellets during acceleration to reduce deformation further. These feature elements reduced dispersion rate. Alternate shot materials, such as steel or tungsten, maintain spherical shape to reduce dispersion, but have other shortcoming, such as low density or extremely high cost.

SUMMARY

Embodiments of this invention provide a buffering system to reduce or eliminate shot pellet deformation during acceleration at ignition, and preferably enhance pattern performance. The granulated/particulate buffers intermixed in the shot column, as described above, often do not effectively occupy all the space between shot pellets, and thus, still allow some pellet deformation. According to a preferred embodiment of this invention, the shot pellets, or a significant portion of the shot pellets, are substantially completely surrounded by a hard, brittle matrix that provides conformal support of the pellets during cartridge ignition. The matrix preferably substantially completely separates from the shot column a short distance after muzzle exit without significant adherence to the pellets.

U.S. Pat. No. 34,806 discloses filling pellet interstices with some melted substances, such as grease, wax, or low melt metallic alloys for the purpose of creating a fixed shot charge between two wads. Wax or grease is not sufficiently hard or brittle to properly buffer the shot, particularly at the temperatures encountered in shotshells, and is unlikely to satisfy the requirements noted. A right-cylinder shaped unit of shot pellets and paraffin wax starts deforming after just four hours exposure to 125° F., with complete loss of shape in less than 24 hours. Cartridges stored in a garage, attic or in the trunk of a car in the summer can easily exceed 125° F. Low melt metallic alloys would be costly and could add significant parasitic weight to the cartridge payload. U.S. Pat. No. 3,422,761 discloses embedding shot pellets in a matrix of polyurethane foam for the purpose of containing or securing the pellets in an open mouth shellcase. While containment may be achieved, the very nature of foam products creates the air gaps in the shot column that are undesirable for a buffering system. Air gaps in foam can collapse upon ignition and result in significant pellet deformation. U.S. Pat. Nos. 4,913,054 and 6,367,388 disclose methods of embedding or containing multiple projectiles as a single projectile until impact with a target. Multiple projectiles bound together and acting as a single projectile in flight would be undesirable for a shotshell pattern, and in many hunting applications, it would be in violation of hunting regulations. U.S. Pat. No. 4,733,611 discloses shot pellets embedded in a wax/Styrofoam matrix, but as described above, a wax-based matrix can be unsatisfactory for buffering.

Embodiments of this invention can provide a buffering system for multi-projectile shot cartridges which provides conformal support to individual pellets to reduce or eliminate pellet deformation. Embodiments of this invention can provide a buffering system for multi-projectile shot cartridges which reduces dispersion rate of the shot pellets after exiting the gun barrel. Some embodiments are capable of meeting or exceeding the pattern performance of tungsten-based shot loads at a considerably lower cost.

DETAILED DESCRIPTION

Example embodiments will now be described more fully with reference to the accompanying drawings.

Figure 1:
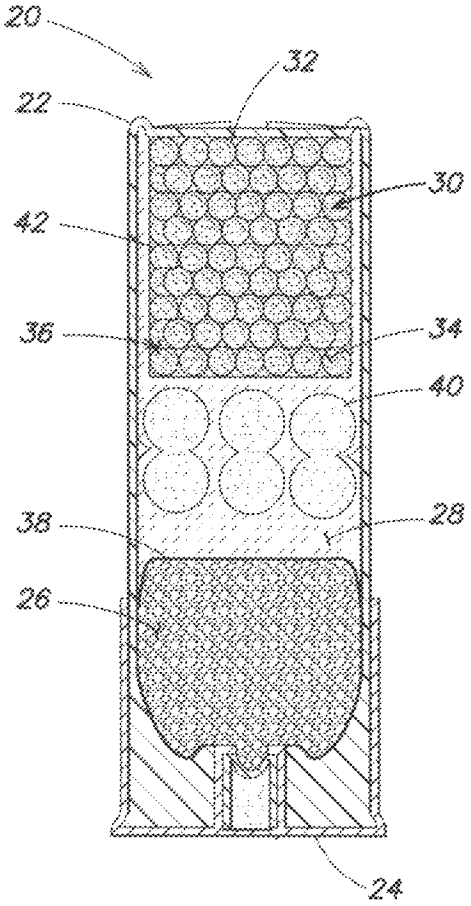
FIG. 1 is a cross-section of a preferred embodiment of a shotshell cartridge constructed, according to the principles of this invention.

A preferred embodiment of a shotshell in accordance with the principles of this invention is indicated generally as 20 in FIG. 1. The shotshell 20 is generally of the type having a hull 22, with a head 24 at the proximal end of the hull. A charge of propellant 26 is disposed in the hull 22. A wad 28 is disposed in the hull 22 distal to the propellant 26. A load 30 is disposed in the hull 22 distal to the wad 28. The load 30 includes a plurality of individual shot or pellets 32, at least a portion of which are at least partially surrounded by a friable material 34 forming a matrix 36 that breaks up upon the firing of the shell to release to the shot. The matrix is preferably a polymeric material, but could be some other brittle, friable material.

The hull 22 is preferably a conventional hull made of a polymeric material. The head 24 is preferably made of plated steel or brass, but it could be made of some other material. The propellant 26 can be any conventional propellant. The wad system 28 preferably includes a gas sealing cup wad 38, a ballistic cushion section 40, and a cup section 42 to house the shot or pellets 32. This wad system can be a one-piece wad as shown, or it can be a multi-piece wad system.

The shot or pellets 32 can be conventional round shot of any desired size from birdshot sizes to buckshot sizes. The shot or pellets 32 can be other shapes and sizes, as well. The shot or pellets 32 can be made of lead or lead alloy, or other suitable material, including copper, tungsten, bismuth, or steel.

Figure 3:
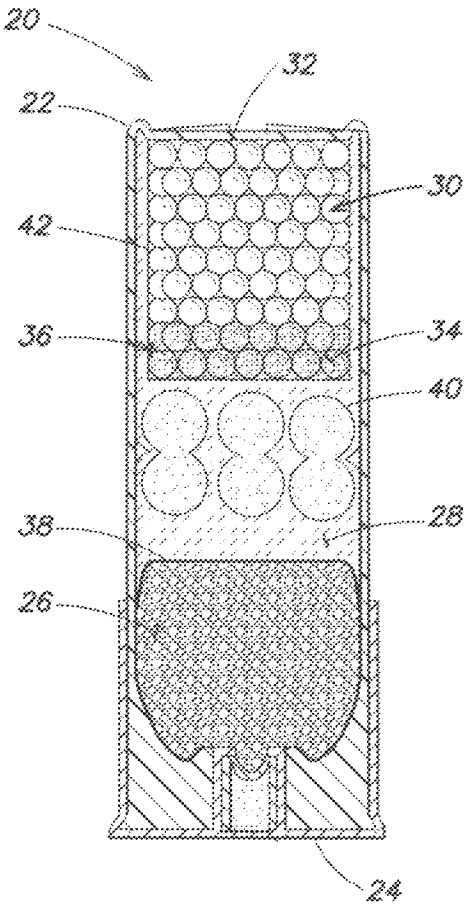
FIG. 3 is a cross-section of a second alternate construction of the preferred embodiment of a shotshell cartridge constructed, according to the principles of this invention.
Figure 2:
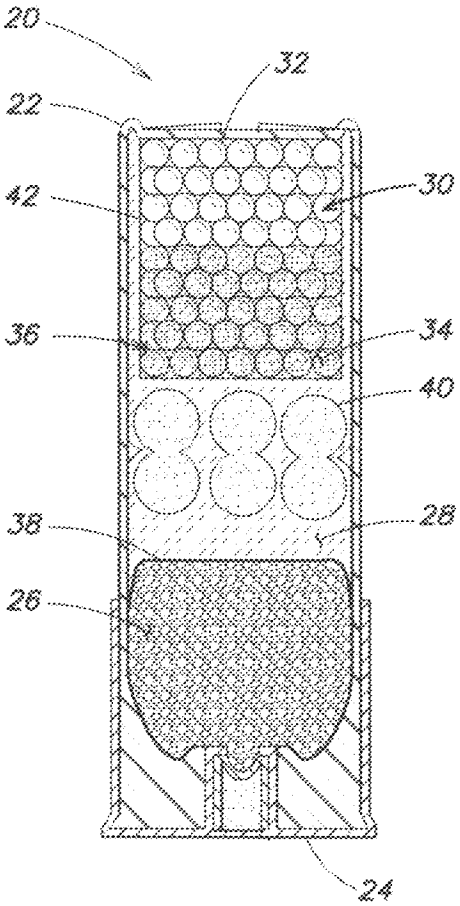
FIG. 2 is a cross-section of an alternate construction of the preferred embodiment of a shotshell cartridge constructed, according to the principles of this invention.

At least the proximal-most shot or pellets 32 are at least partially surrounded by friable material 34 (FIG. 3). More preferably about half of the shot or pellets 32 are at least partially surrounded by friable material 24 (FIG. 2), and most preferably substantially all of the pellets are at least partially surrounded by friable material (FIG. 1).

The friable material 34 is preferably a polymer, but can be other materials with or without fillers to achieve desired mechanical properties. An example of a suitable material is polyurethane resin with trade name Smash! Plastic®. The friable material preferably has a hardness of greater than about 50 (Shore D). The friable material preferably has a compressive strength of less than about 5000 psi and greater than about 200 psi. The friable material preferably has a Gardner impact strength below about 30 in-lbs. Equally, or perhaps more important, are mechanical properties of the shot pellets/friable matrix material unit. For right cylinder units approximately 0.70" diameter×1.37" long, Gardner impact strengths of less than 20 in-lbs, and compressive strengths of less than 300 lbs are preferred.

Table 1 shows the properties of one suitable polyurethane, Smash! Plastic®. This table shows the peak compression load for a 0.745 inch diameter cylinder of Smash! Plastic®, and the peak compression load for a 0.740 diameter cylinder of Smash! Plastic and pellets, for five different trials. The testing was done using an INSTRON 5500R with Bluehill Software, at 70° F. and 30% relative humidity.

TABLE 1

| Specimen | Smash Resin Peak Compression Load-Lbs. | Smash Resin with Shot Pellets Peak Compression Load-Lbs. |
|---|---|---|
| 1 | 989.0 | 68.3 |
| 2 | 788.8 | 30.4 |
| 3 | 762.3 | 52.9 |
| 4 | 853.0 | 26.5 |
| 5 | 935.7 | 44.5 |
| Average | 865.8 | 44.5 |

Preferably, the matrix 36 in the form of a liquid, is dispensed in the cup section, followed by a charge of shot pellets. Alternatively, the shot pellets can be introduced first, followed the matrix in liquid form, or the shot pellets and matrix in the form of a liquid can be mixed and introduced together. In a preferred embodiment, the pellets are pre-coated with a release agent, such as a mold release for example, Universal Mold Release® agent, available from Smooth-On, Inc., 2000 Saint John Street, Easton Pa. 18042, to reduce bonding between the matrix and the pellets. The matrix material is preferably a two-part polyurethane resin, such as Smash! Plastic®, available from Smooth-On, Inc., 2000 Saint John Street, Easton Pa. 18042 or material with similar properties. Smash! Plastic® has a mixed viscosity of about 900 cps, a cured specific gravity of about 1.036 g/cc, and a hardness of about 65-80 (Shore D). Smash! Plastic® is prepared by mixing equal amounts of two components, Part A, a modified aliphatic diisocyanate, containing Dicyclohexylmethane-4, 4'diisocyanate, and Part B, a resin. The material must be sufficiently brittle to break up upon firing of the shell so that the individual pellets comprising the load are freed.

Accurately dispensing a two-part resin can be accomplished with a unit, such as the Bartec B1000, a gear pump metered dispenser.

By introducing the pellets after the liquid matrix, the pellets settle into the liquid matrix, providing a shot column with all spaces between pellets substantially completely filled by the matrix material. The viscosity and gel time of the resin permit pellets to fall through the resin, yet resist resin flowing past the cushion wad or powder cup into powder column. A folded tube crimp or top wad and roll crimp provide closure of the cartridge. In one preferred embodiment, the closure includes a frangible top wad. A properly fitted top wad and roll crimp prevents leakage of matrix material during cure/set to allow immediate packing of cartridges.

Figure 4:
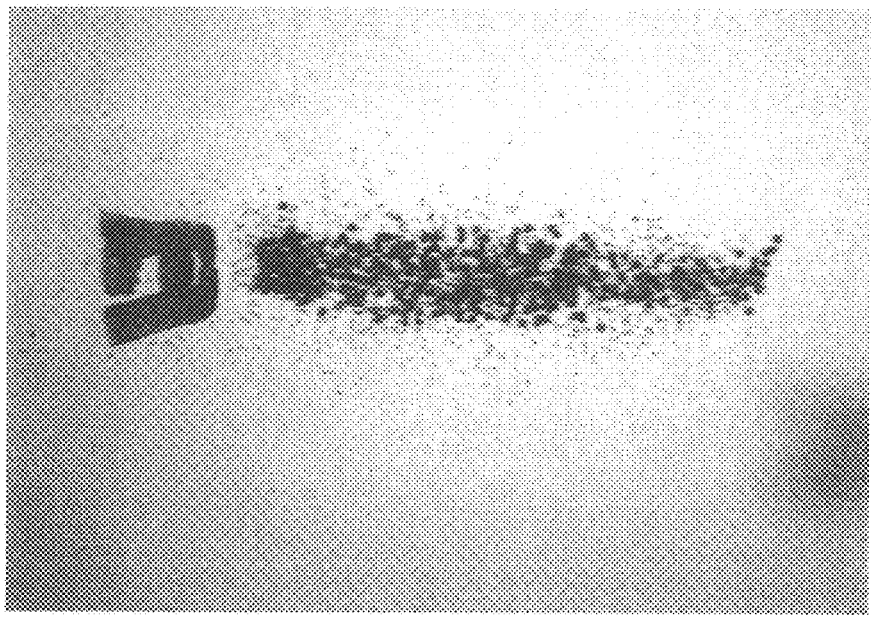
FIG. 4 is a photograph showing the shot and wadding at about 4 feet from the shotgun muzzle of a typical lead shotshell buffered with small polyethylene particles.
Figure 5:
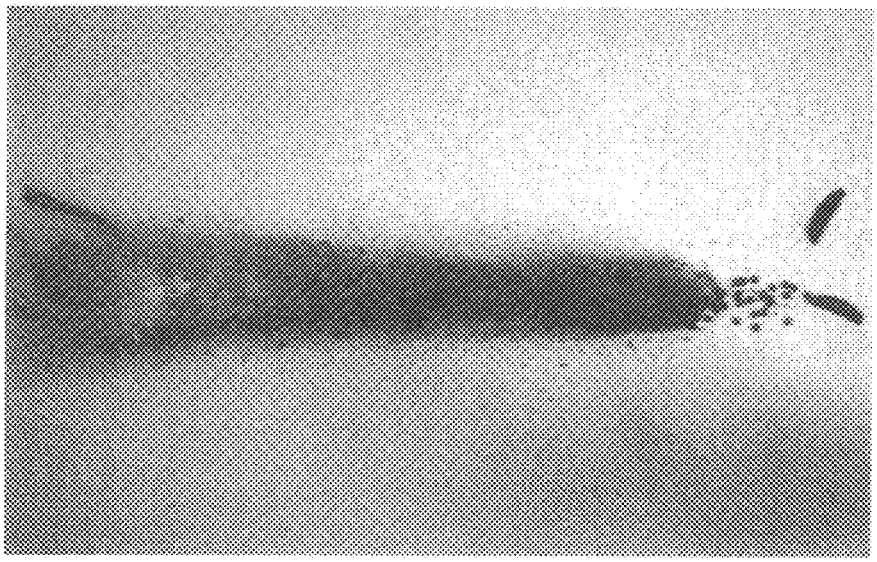
FIG. 5 is a photograph showing the shot and wadding at about 4 feet from the shotgun muzzle of a shotshell cartridge using the buffering system of the preferred embodiment of the present invention.

After an appropriate cure cycle, the liquid matrix becomes a hard, brittle solid. Upon cartridge ignition and load acceleration, the solid matrix breaks into small particles and travels down the barrel, still occupying the space between individual pellets. At muzzle exit, the shot cup petals deploy and the small matrix particles and begin to separate from the shot column. During launch, the hard matrix provides conformal support to individual pellets to reduce, or preferably substantially eliminate pellet deformation. During separation near muzzle exit, the particles can provide a temporary windshield effect, further improving pattern performance as seen in FIG. 5 compared to standard cartridge of FIG. 4.

In another embodiment of the present invention, shot cups, shot, and matrix are pre-assembled and cured ahead of subsequent loading in the cartridge. The preassembled and cured shot cups with the shot in a hardened matrix can be loaded into the hull.

Example 1

Exemplary shotshell cartridges constructed in accordance with a preferred embodiment of the present invention were tested against two commercially available shotshell cartridges designed to have tight patterns for turkey hunting applications.

A) Winchester product symbol STH1236, 12 gauge 3" 1¾ oz Copper Plated #6 lead shot, with PE particles for shot buffering.

B) Winchester product symbol STXS1236, 12 gauge 3" 1¾ oz Tungsten-based #6 shot, with polystyrene particles for shot buffering.

C) Exemplary cartridges in accordance with the preferred embodiment of this invention, 12 gauge 3" 1¾ oz Copper plated #6 lead shot, with 4 grams Smash Plastic® polyurethane resin and pellets pre-coated with Universal Mold Release® spray.

All three samples utilize similar wad systems involving a gas sealing powder cup, ballistic cushion member, and a 4 petal shot cup. All samples fired in a Remington 870 shotgun with a Rhino .660 choke tube. Percentages shown are ratio of pellets in the target area to total pellets in the cartridge, and are an average of ten cartridge patterns each. High pattern percentages equate to reduced pellet dispersion. The results are shown in Table 2.

TABLE 2

| Sample | Distance | 10" Circle | 20" Circle | 30" Circle |
|---|---|---|---|---|
| A | 40 yards | 22% | 55% | 81% |
| B | 40 yards | 32% | 73% | 92% |
| C | 40 yards | 48% | 84% | 95% |
| A | 60 yards | 8% | 21% | 39% |
| B | 60 yards | 12% | 32% | 56% |
| C | 60 yards | 21% | 53% | 78% |

The data in Table 2 shows the exemplary cartridges (C) had twice the performance (i.e., half the dispersion) of standard lead shot turkey load (A) in several trials, and exceeded tungsten-based shot loads (B) in all the trials.

Example 2

Exemplary shotshell cartridges constructed in accordance with a preferred embodiment of the present invention were tested against alternate matrix materials, some of which have been identified in previous patents. The cartridges are assembled in similar fashion with the exception of the matrix material. Mold release was not used on samples B, C, or D since the respective patents did not disclose use of such coatings on pellets.

A) Subject inventive cartridges, 12 gauge 3" 1¾ oz Copper plated #6 lead shot, with 4 grams Smash Plastic® polyurethane resin and pellets pre-coated with Universal Mold Release® spray.

B) Same as above, except use of paraffin wax as matrix per U.S. Pat. 34,806. A weight of 3.2 grams of wax adequately filled the shot column.

C) Same as above, except use of polyurethane foam as matrix per U.S. Pat. No. 3,422,761. Great Stuff polyurethane foam by DOW was selected for this trial. A weight of 0.6 grams adequately filled the shot column.

D) Same as above, except use of epoxy Cytec RN-1000 resin with EA-02 hardener as matrix.

TABLE 3

| Sample | Distance | 20"Circle | 30" Circle |
|---|---|---|---|
| A | 60 yds | 56% | 79% |
| B | 60 yds | 10% | 22% |
| C | 60 yds | 9% | 21% |
| D | 60 yds | Slug* | Slug* |

*this matrix did not break up or fracture at cartridge ignition, and traveled to target as single projectile.

As seen in the table above, properties of the inventive cartridge provide differentiation and significant enhanced pattern performance over prior art and other alternate buffering materials.

Example 3

To differentiate properties of various matrix materials of interest, samples were prepared for a crush strength test. The size and shape of the samples were to duplicate the interior of the shot cup used in the above cartridge pattern evaluations, or an approximate right cylinder measuring 0.70" OD×1.37" height. The shot cup is used as the "mold". Leftover samples from the pattern test were disassembled, shot cup petals peeled back, and shot/matrix units extracted. An INSTRON MODEL 5500R was used to record load to fail crush strength in axial directions. Sample size of 5 per trial was used. Also shown, are impact strength values in the axial direction for these units using a Gardner Impact Tester with 1.0" flat steel punch with one pound weight. Matrix material amounts shown were amounts needed to cover most of the shot column.

TABLE 4

| Matrix Material | Unit Crush Strength, lb | Unit Impact Strength, in-lb | Material Hardness |
|---|---|---|---|
| 4 gm Smash! Plastic | 44.5 | <2.0 | 70 (Shore D) |
| 3.2 gm Paraffin Wax | 30.6 | 6.4 | 75 (Share A) |
| 0.6 gm Great Stuff foam | 204.8 | 16.1 | 44 (Shore A) |
| 4 gm Cytec RN1000/EA02 | 1135.9 | 33.3 | 80 (Shore D) |

The load of shot and matrix can be formed in situ in the shotshell casing, or it can be formed separately, and installed as a unit into the shotshell.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An improved shotshell of the type having a hull, a head at the proximal end, propellant disposed in the hull, a wad having a proximally facing side and a distally facing side disposed in the hull with the propellant on the proximally facing side of the wad, and a load disposed in the hull on the distally facing side of the wad, the improvement comprising the load including a plurality of individual shot, at least a portion of which are substantially completely surrounded by a solid, hard, brittle, friable resin material matrix having a compressive strength of less than 5000 psi to provide conformal support for the shot but which breaks up upon the firing of the shell into small particles that travel down the barrel of the gun still occupying the spaces between individual shot.

2. The shotshell according to claim 1, wherein at least the proximal-most pellets are substantially completely surrounded by the matrix.

3. The shotshell according to claim 1, wherein about half of the pellets are substantially completely surrounded by the matrix.

4. The shotshell according to claim 1, wherein substantially all of the pellets are substantially completely surrounded by the matrix.

5. The shotshell according to claim 1, wherein the matrix comprises a polyurethane.

6. The shotshell according to claim 5, wherein the polyurethane comprises Smash! Plastic®.

7. The shotshell according to claim 1, wherein the matrix has a hardness of greater than about 50 (Shore D).

8. The shotshell according to claim 1, wherein the load and matrix has a compressive load to fail of less than about 300 lbs in the axial direction.

9. The shotshell according to claim 1, wherein the load and matrix have a Gardner Impact Strength of less than about 20 in-lbs in the axial direction.

10. The shotshell according to claim 1, wherein the matrix has a hardness greater than about 50 (Shore D), compressive strength between about 200 psi and about 5000 psi, and the shot pellets and matrix have a compressive load to fail of less than about 300 lbs and Gardner Impact Strength of less than about 20 in-lbs.

11. A shotshell cartridge comprising having a hull, a head at the proximal end, propellant disposed in the hull, a wad having a proximally facing side and a distally facing side disposed in the hull with the propellant on the proximally facing side of the wad, and a load disposed in the hull on the distally facing side of the wad, the load comprising a plurality of projectiles at least partially embedded in a solid, hard, brittle polymeric resin material matrix with a hardness of between about 50 and about 80 (Shore D) which provides conformal support to the individual projectiles during cartridge ignition and projectile acceleration, the matrix material having a compressive strength of greater than 200 psi and less than 5000 psi so that it is friable and breaks up upon the firing of the shell, separating from projectiles near the muzzle exit; reducing the dispersion of the projectiles outside the firearm compared to similar cartridges without the matrix.

12. A cartridge according to claim 11, wherein the projectiles and the matrix have a compressive load to fail of less than about 300 lbs in the axial direction.

13. A cartridge according to claim 11, wherein the projectiles and the matrix material have a Gardner Impact Strength of less than 20 in-lbs in the axial direction.

14. The cartridge according to claim 11, wherein projectiles and matrix material has a compressive load to fail of less than about 300 lbs and Gardner Impact Strength of less than about 20 in-lbs.

15. The cartridge according to claim 11, wherein the matrix material is a solid polyurethane resin.

16. The cartridge according to claim 15, wherein the matrix material is Smash Plastic®.

17. The cartridge according to claim 15, wherein the projectiles are pre-coated with a silicon-based mold release.

18. The cartridge according to claim 11, wherein the projectiles are pre-coated with a release agent to aid in the clean separation of the projectiles from the matrix near muzzle exit.

19. The cartridge according to claim 11, wherein the projectile size ranges from 0.080 to 0.36".

20. The cartridge according to claim 11, wherein the projectiles are made of lead, tin, bismuth, copper, steel, zinc, tungsten, nickel, nylon, or polymers, or mixtures of alloys of said materials.

21. The cartridge according to claim 11 further comprising a top wad closure distal to the load.

22. The cartridge according to claim 21 wherein the top wad is frangible.

* * * * *